US007106278B2

(12) United States Patent
Kim et al.

(10) Patent No.: US 7,106,278 B2
(45) Date of Patent: Sep. 12, 2006

(54) PLASMA DISPLAY PANEL AND DRIVING METHOD THEREOF

(75) Inventors: Jae Sung Kim, Kumi-shi (KR); Eun Cheol Lee, Kumi-shi (KR); Seok Dong Kang, Kumi-shi (KR)

(73) Assignee: LG Electronics Inc., Seoul (KR)

( * ) Notice: Subject to any disclaimer, the term of this patent is extended or adjusted under 35 U.S.C. 154(b) by 837 days.

(21) Appl. No.: 09/773,935

(22) Filed: Feb. 2, 2001

(65) Prior Publication Data

US 2001/0024092 A1 Sep. 27, 2001

(30) Foreign Application Priority Data

Mar. 2, 2000 (KR) ..... 00-5457

(51) Int. Cl.
*G09G 3/28* (2006.01)

(52) U.S. Cl. ..... 345/60; 345/67; 345/68; 315/169.4

(58) Field of Classification Search ..... 345/60–68, 345/74.1, 76, 55, 41, 43; 315/167–168, 169.1, 315/169.4, 169.3; 313/484, 491, 514, 517, 313/520, 584, 586, 587
See application file for complete search history.

(56) References Cited

U.S. PATENT DOCUMENTS 5,747,939 A * 5/1998 Kim et al. ..... 315/169.4
5,818,168 A * 10/1998 Ushifusa et al. ..... 313/582
5,939,828 A * 8/1999 Matsuzaki et al. ..... 313/584
6,104,362 A * 8/2000 Kuriyama et al. ..... 345/63
6,249,264 B1 * 6/2001 Sano et al. ..... 345/60
6,255,779 B1 * 7/2001 Ha et al. ..... 313/582
6,281,628 B1 * 8/2001 Choi et al. ..... 313/585
6,369,781 B1 * 4/2002 Hashimoto et al. ..... 345/60
6,407,503 B1 * 6/2002 Mizobata ..... 313/587
6,414,435 B1 * 7/2002 Akiba ..... 313/584
6,504,519 B1 * 1/2003 Ryu et al. ..... 345/60
6,531,995 B1 * 3/2003 Ishii et al. ..... 345/67

FOREIGN PATENT DOCUMENTS

JP 08-306318 11/1996

* cited by examiner

*Primary Examiner*—Ricardo Osorio
*Assistant Examiner*—Mansour M. Said
(74) *Attorney, Agent, or Firm*—Fleshner & Kim, LLP

(57) ABSTRACT

A plasma display panel and a driving method thereof that are capable of improving the discharge efficiency and the brightness. In the panel, sustaining electrodes are formed at the boundary portions between the discharge cells. Trigger electrodes are formed at the inner sides of the discharge cells. Lattice-shaped barrier ribs are formed in such a manner to surround the discharge cells. The method of driving the panel includes a reset period, an address period and a sustaining period. In the method, a reset pulse is applied to the sustaining electrodes during the reset period. A scanning pulse is applied to the trigger electrodes during the address period. A first sustaining pulse is applied to the trigger electrodes during the sustaining period. A second sustaining pulse is applied to the sustaining electrodes in such a manner to be alternate with the first sustaining pulse. Accordingly, the PDP causes a sustaining discharge using three electrodes within the discharge cell to increase a discharge frequency per sustaining pulse into two time in comparison to the prior art and to make a long-distance discharge and an enlargement of light-emission area, thereby realizing a high efficiency and a high brightness.

23 Claims, 13 Drawing Sheets

PLASMA DISPLAY PANEL AND DRIVING METHOD THEREOF

BACKGROUND OF THE INVENTION

1. Field of the Invention

This invention relates to a plasma display panel, and more particularly to a plasma display panel that is capable of improving the discharge efficiency and the brightness. The present invention also is directed to a method for driving the plasma display panel.

2. Description of the Related Art

Generally, a plasma display panel (PDP) radiates a fluorescent body by an ultraviolet with a wavelength of 147 nm generated during a discharge of He+Xe or Ne+Xe gas to thereby display a picture. Such a PDP is easy to be made into a thin-film and large-dimension type. Moreover, the PDP provides a very improved picture quality owing to a recent technical development. Such a PDP is largely classified into a direct current (DC) type and an alternating current (AC) type. The DC-type PDP causes an opposite discharge between an anode and a cathode provided at a front substrate and a rear substrate, respectively to display a picture. On the other hand, the AC-type PDP allows an AC voltage signal to be applied between electrodes having dielectric layer therebetween to generate a discharge every half-period of the signal, thereby displaying a picture. Such a PDP typically includes an AC-type, surface-discharge PDP that has three electrodes as shown in FIG. 1 and is driven with an AC voltage.

Referring to FIG. 1, a scanning/sustaining electrode 16 and a common sustaining electrode 17 making a sustaining surface-discharge by an application of a AC driving signal are arranged, in parallel, at the rear side of an upper glass substrate 14 constructing the upper substrate 10. The scanning/sustaining electrode 16 and the common sustaining electrode 17 are transparent electrodes made from indium-tin-oxide (ITO), and metal bus electrodes 20 for supplying AC signals are formed, in parallel, on each of the scanning/sustaining electrode 16 and the common sustaining electrode 17. Because of a high resistance of the transparent electrode, a signal applied from a real external driver is applied, via the metal bus electrode 20, to the transparent electrode of each discharge cell. An upper dielectric layer 18 is entirely formed at the rear side of the upper glass substrate 14 provided with the scanning/sustaining electrode 16 and the common sustaining electrode 17. The upper dielectric layer 18 is responsible for accumulating electric charges during the discharge and limiting a discharge current. A protective layer 21 entirely coated on the upper dielectric layer 18 protects the upper dielectric layer 18 from the sputtering during the discharge to prolong a life of the pixel cell as well as to enhance an emission efficiency of secondary electrons, thereby improving a discharge efficiency. On a lower glass substrate 22 constructing the lower substrate 12, an address electrode 22 is arranged perpendicularly to the scanning/sustaining electrode 16 and the common sustaining electrode 17. A lower dielectric layer 26 for forming wall charges during the discharge is entirely coated on the lower glass substrate 22 and the address electrode 24. Barrier ribs 32 are vertically formed between the upper substrate 10 and the lower substrate 12. The barrier ribs 32 arranged, in parallel to the address electrode 24, on the lower dielectric layer 26 defines a discharge space 28 along with the upper substrate 10 and the lower substrate 12, and shut off an electrical and optical interference between the adjacent discharge cells. In order to minimize an interference between the adjacent discharge cells, the barrier ribs 32 may be formed in a direction horizontal to the address electrode 24 as well as in a direction vertical to the address electrode 24 to have a lattice-shaped structure. A fluorescent material 30 are coated on the surfaces of the lower dielectric layer 26 and the barrier ribs 32. The discharge space 28 is filled with a mixture gas of He+Xe or Ne+Xe.

Referring to FIG. 2, a driving apparatus for the AC-type PDP includes a PDP 40 in which m×n discharge cells 44 are arranged in a matrix pattern in such a manner to be connected to scanning/sustaining electrode lines Y1 to Ym, common sustaining electrode lines Z1 to Zm and address electrode lines X1 to Xn, a scanning/sustaining electrode driver 36 for driving the scanning/sustaining electrode lines Y1 to Ym, a sustaining electrode driver 34 for driving the common sustaining electrode lines z1 to Zm, and first and second address electrode drivers 38A and 38B for making a divisional driving of odd-numbered address electrode lines X1, X3, . . . , Xn−3, Xn−1 and even-numbered address electrode lines X2, X4, . . . Xn−2, Xn. The scanning/sustaining electrode driver 36 sequentially applies a scanning pulse and a sustaining pulse to the scanning/sustaining electrode lines Y1 to Ym, thereby allowing the discharge cells to be sequentially scanned line by line and allowing a discharge at each of the m×n discharge cells 44 to be sustained. The common sustaining electrode driver 34 applies a sustaining pulse to all of the common sustaining electrode lines Z1 to Zm. The first and second address electrode drivers 38A and 38B supplies an image data to the address electrode lines X1 to Xm in such a manner to be synchronized with the scanning pulse. The first address electrode driver 38A supplies the odd-numbered address electrode lines X1, X3, . . . , Xn−3, Xn−1 with an image data while the second address electrode driver 38B supplies the even-numbered address electrode lines X2, X4, . . . , Xn−2, Xn with an image data.

Such a PDP driving method typically includes a sub-field driving method in which the address interval and the discharge-sustaining interval are separated. In this sub-field driving method, as shown in FIG. 3, one frame 1F is divided into n sub-fields SF1 to SFn corresponding to each bit of an n-bit image data. Each sub-field SF1 to SFn is again divided into a reset interval RP, an address interval AP and a discharge-sustaining interval SP. The reset interval RP is an interval for initializing a discharge cell, the address interval AP is an interval for generating a selective address discharge in accordance with a logical value of a video data, and the sustaining interval SP is an interval for sustaining a discharge at the discharge cell 44 in which the address discharge has been generated. The reset interval RP and the address interval AP are equally allocated in each sub-field interval. A weighting value with a ratio of $2^0: 2^1: 2^2: \ldots :2^{n-1}$ is given to the discharge sustaining interval SP to express a gray scale by a combination of the discharge sustaining intervals SP.

FIG. 4 is waveform diagrams of driving signals applied to the PDP during a certain one sub-field interval SFi. In the reset interval RP, a priming pulse Pp is applied to the common sustaining electrode. By this priming pulse Pp, a reset discharge is generated between each common sustaining electrode Zm and each scanning/sustaining electrode Y1 to Ym of the entire discharge cells to initialize the discharge cells. At this time, a voltage pulse lower than the priming pulse Pp is applied to the address electrode An so as to prevent a discharge between the address electrode An and the common sustaining electrode Zm. By the reset discharge, a large amount of wall charges are formed at the common sustaining electrode Zm and the scanning/sustaining electrode Y1 to Ym of each discharge cell. Subsequently, a self-erasure discharge is generated at the discharge cells by the large amount of wall charges to eliminate the wall charges and leave a small amount of charged particles. These small amount of charged particles help an address discharge in the following address interval. In the address interval AP, a scanning voltage pulse −Vs is applied line-sequentially to the first to mth scanning/sustaining electrodes Y1 to Ym. At the same time, a data pulse Vd according to a logical value of a data is applied to the address electrodes An. Thus, an address discharge is generated at discharge cells to which the scanning voltage pulse −Vs and the data pulse Vd are simultaneously applied. Wall charges are formed at the discharge cells in which the address discharge has been generated. During this address interval AP, a desired constant Voltage is applied to the common sustaining electrodes Zm to prevent a discharge between each address electrode An and each common sustaining electrode Zm. In the sustaining interval SP, a sustaining pulse Sp is alternately applied to the first to mth scanning/sustaining electrodes Y1 to Ym and the common sustaining electrodes Zm. Accordingly, a sustaining discharge is generated continuously only at the discharge cells formed with the wall charges by the address discharge to emit a visible light.

The AC-type PDP driven in this manner still requires to overcome several factors causing deterioration in the efficiency and the brightness. In the AC-type PDP as shown in FIG. 1, the scanning/sustaining electrode Ym and the common sustaining electrode Zm causing a sustaining surface-discharge are arranged in such a manner to be spaced at a short distance within a narrow discharge cell. When a scanning voltage pulse is alternately applied to the scanning/sustaining electrode Ym and the common sustaining electrode Zm, a discharge is initiated at a gap between the two electrodes and then a discharge area is enlarged into the surfaces of the two electrodes.

However, in such an AC-type PDP structure, since a distance between the scanning/sustaining electrode Ym and the common sustaining electrode Zm is short, a discharge path upon sustaining discharge is short to generate a small quantity of ultraviolet rays and a light-emission area within the discharge cell is extremely limited. This causes a deterioration of brightness.

Also, the AC-type PDP structure has a problem in that, as a distance between the scanning/sustaining electrode Ym and the common sustaining electrode Zm is increased so as to increase the discharge path and the light-emission area, an erroneous discharge with other adjacent cells is generated. Furthermore, a ratio of time contributing to a real light-emission in the entire sustaining interval during the sustaining period determining the brightness of the PDP is very low to cause a deterioration in the efficiency and the brightness.

A pulse width of the sustaining pulse alternately applied to the scanning/sustaining electrode Ym and the common sustaining electrode Zm in the sustaining interval SP is several μs. But, since a discharge is really generated only at a short instant supplied with a pulse, a time contributing to a real light-emission becomes merely 1 μs for each pulse. The discharge is generated once only at a very short instant for a single pulse while charged particles produced upon discharge in the remaining time are moved along the discharge path in accordance with the polarity of the electrode to form wall charges at the surface of the dielectric layer positioned at the lower portion of the electrode. Thus, an electric field at the discharge space is lowered and a discharge voltage is decreased, to thereby stop the discharge. As a result, since the major time of the sustaining interval SP is wasted for a formation of wall charges and a preparation for the next discharge, the entire sustaining interval fails to be exploited efficiently, thereby causing a deterioration in the discharge and light-emission efficiency and the brightness.

SUMMARY OF THE INVENTION

Accordingly, it is an object of the present invention to provide a plasma display panel (PDP) wherein a discharge distance is increased to make a high efficiency, a light-emission area is enlarged to obtain a high brightness, and a light-emission time is increased to improve a light-emission efficiency.

A further object of the present invention is to provide a PDP driving method wherein said PDP can be driven by an active system.

In order to achieve these and other objects of the invention, a plasma display panel according to one aspect of the present invention includes sustaining electrodes formed at the boundary portions between the discharge cells; and trigger electrodes formed at the inner sides of the discharge cells.

A method of driving a plasma display panel according to another aspect of the present invention includes the steps of applying a reset pulse to sustaining electrodes during a reset period; applying a scanning pulse to trigger electrodes during an address period; applying a first sustaining pulse to the trigger electrodes during a sustaining period; and applying a second sustaining pulse to the sustaining electrodes in such a manner to be alternate with the first sustaining pulse.

A method of driving a plasma display panel according to still another aspect of the present invention includes a first sub-field for applying a scanning voltage pulse to odd-numbered trigger electrodes during an address period; and a second sub-field for applying a scanning voltage pulse to even-numbered trigger electrodes during the address period.

A method of driving a plasma display panel according to still another aspect of the present invention includes a first sub-field for applying a scanning voltage pulse to even-numbered trigger electrodes during an address period; and a second sub-field for applying a scanning voltage pulse to odd-numbered trigger electrodes during the address period.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 5:
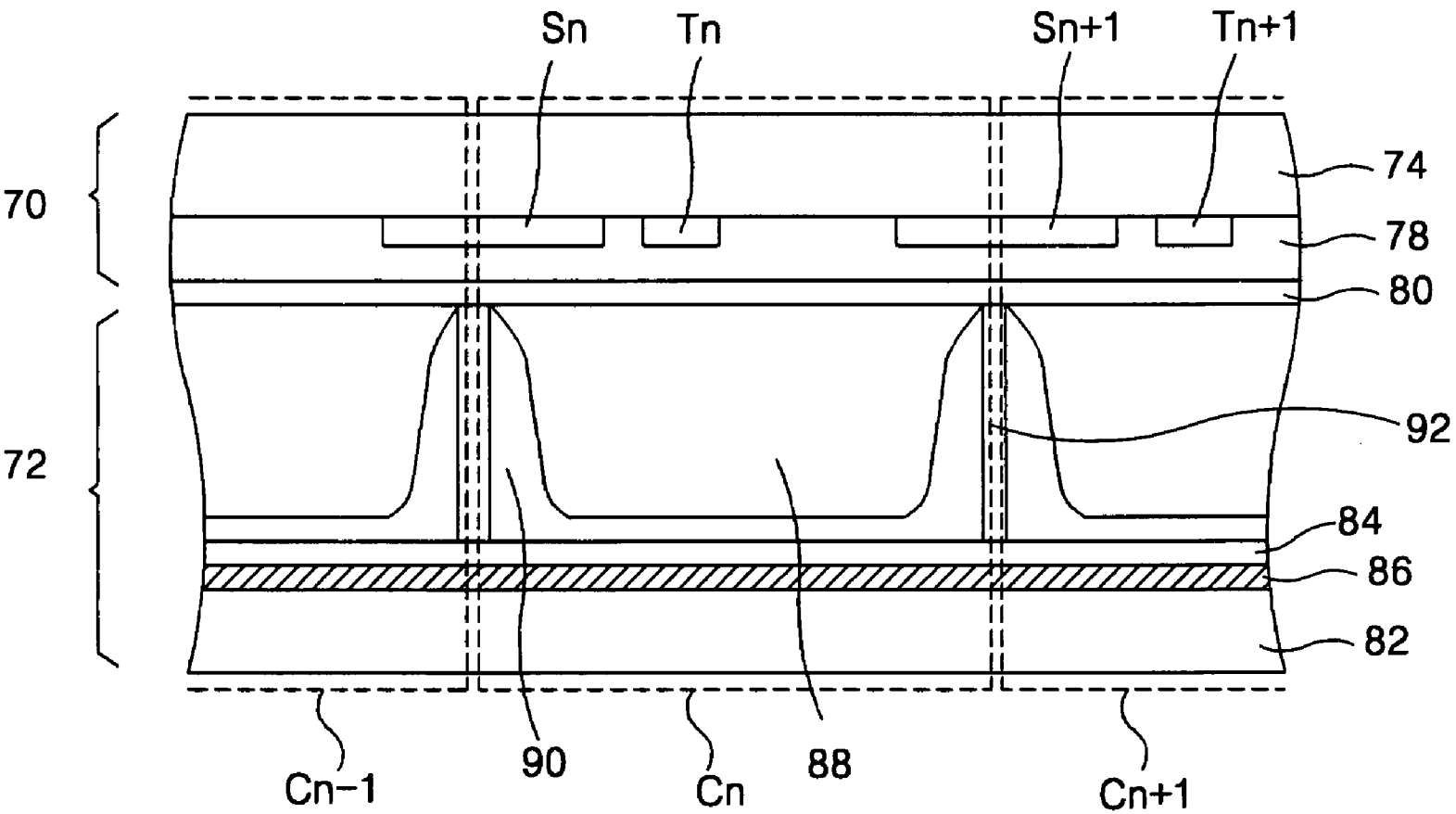
FIG. 5 is a vertical section view showing a discharge cell structure of an AC surface-discharge plasma display panel according to a first embodiment of the present invention.

FIG. 5 is a vertical section view showing a discharge cell structure of an AC surface-discharge plasma display panel (PDP) according to a first embodiment of the present invention. Referring to FIG. 5, the AC surface-discharge PDP includes a nth sustaining electrode Sn provided at the rear side of an upper glass substrate 74 at a boundary portion between a (n−1)th discharge cell Cn−1 and a nth discharge cell Cn, and a nth trigger electrode Tn provided at the rear side of the upper glass substrate 74 in such a manner to be spaced at a small distance from the nth sustaining electrode Sn at the nth discharge cell Cn in order to cause a primary sustaining discharge along with the nth sustaining electrode Sn.

As shown in FIG. 5, the nth trigger electrode Tn is arranged between the nth sustaining electrode Sn and a (n+1)th sustaining electrode Sn+1, and a distance between the nth trigger electrode Tn and the (n+1)th sustaining electrode Sn+1 is set to be larger than that between the nth sustaining electrode Sn and the nth trigger electrode Tn. The trigger electrodes Tn and Tn+1 and the sustaining electrodes Sn and Sn+1 are transparent electrodes made from indium-tin-oxide (ITO) so as to prevent a deterioration in the brightness of the PDP.

In the conventional three-electrode structure, a sustaining electrode pair of the scanning/sustaining electrode Ym and the common sustaining electrode Zm are provided at the upper substrate of the discharge cell to cause a sustaining discharge between the two electrodes Ym and Zm. On the other hand, in the present invention, three electrodes of the nth sustaining electrode Sn serving as the first sustaining electrode, the (n+1)th sustaining electrode Sn+1 serving as the second sustaining electrode and the nth trigger electrode Tn cause a sustaining electrode at the nth discharge cell Cn. Meanwhile, since the sustaining electrodes Sn and Sn+1 are formed at the boundary portion between the adjacent discharge cells, two discharge cells Cn−1 and Cn or Cn and Cn+1 have such a structure that they share the sustaining electrode Sn or Sn+1, respectively. In other words, the (n−1)th discharge cell Cn−1 shares the nth sustaining electrode Sn with the nth discharge cell Cn, and the nth discharge cell Cn shares the (n+1)th sustaining electrode Sn+1 with the (n+1)th discharge cell Cn+1. The nth sustaining electrode Sn serves as the first sustaining electrode causing a primary sustaining discharge along with the nth trigger electrode Tn at the nth discharge cell Cn while serving as the second sustaining electrode causing a secondary sustaining discharge along with the (n−1)th trigger electrode Tn−1 at the (n−1)th discharge cell Cn−1. Likewise, the (n+1)th sustaining electrode Sn+1 serves as the second sustaining electrode causing a second sustaining discharge along with the nth trigger electrode Tn after the primary sustaining discharge at the nth discharge cell Cn while serving as the first sustaining electrode causing a first sustaining discharge at the (n+1)th discharge cell Cn+1. At the rear side of the upper glass substrate provided with these electrodes, the upper dielectric layer 78 is formed to have a desired thickness.

Figure 6:
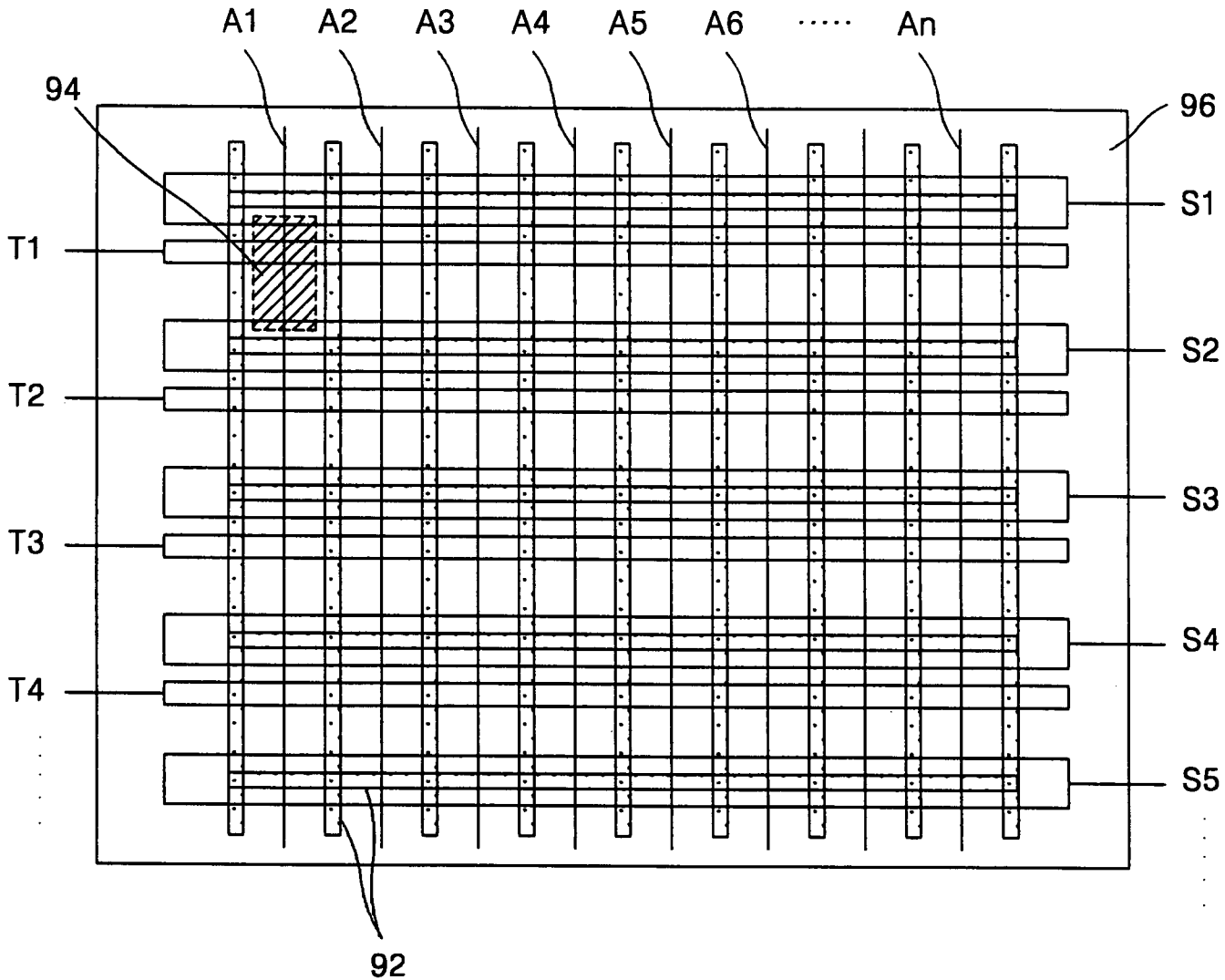
FIG. 6 is a plan view representing an arrangement of the pixel cells and the electrode lines of the AC-type plasma display panel shown in FIG. 5.

Other structures and features except for the structure of the sustaining electrodes provided at the upper substrate 70 are identical to those of the conventional three-electrode, AC surface-discharge PDP. More specifically, a MgO protective layer 80 for protecting the upper substrate 70 from a discharge sputtering is formed at the rear side of the upper dielectric layer 78. An address electrode 86 is formed in a direction perpendicular to the sustaining electrode Sn and the trigger electrode Tn provided at the upper substrate 70 on a lower glass substrate 82 constituting a lower substrate 72. A lower dielectric layer 84 is formed on the lower glass substrate 82 provided with the address electrode 86. As shown in FIG. 6, barrier ribs 92 are formed on the lower substrate 72 provided with the lower dielectric layer 84 in directions parallel to and perpendicular to the address electrode 86.

In the first embodiment, as shown in FIG. 6, the barrier ribs 92 are formed in a lattice shape so as to minimize electrical and optical interference between the adjacent cells positioned at the up, down, left and right sides upon their formation. In this case, the barrier rib 92 is formed at each boundary portion of the scanning lines to position the nth sustaining electrode Sn and the (n+1)th sustaining electrode Sn+1 on the barrier ribs 92. A discharge space 88 surrounded by the upper substrate 70, the lower substrate 72 and the barrier ribs 92 is filled with a mixture gas of He+Xe or Ne+Xe. In FIG. 6, a discharge cell 94 is positioned at each intersection among the sustaining electrode S1 to Sn, the trigger electrodes T1 to Tn and the address electrodes A1 to An.

Figure 7:
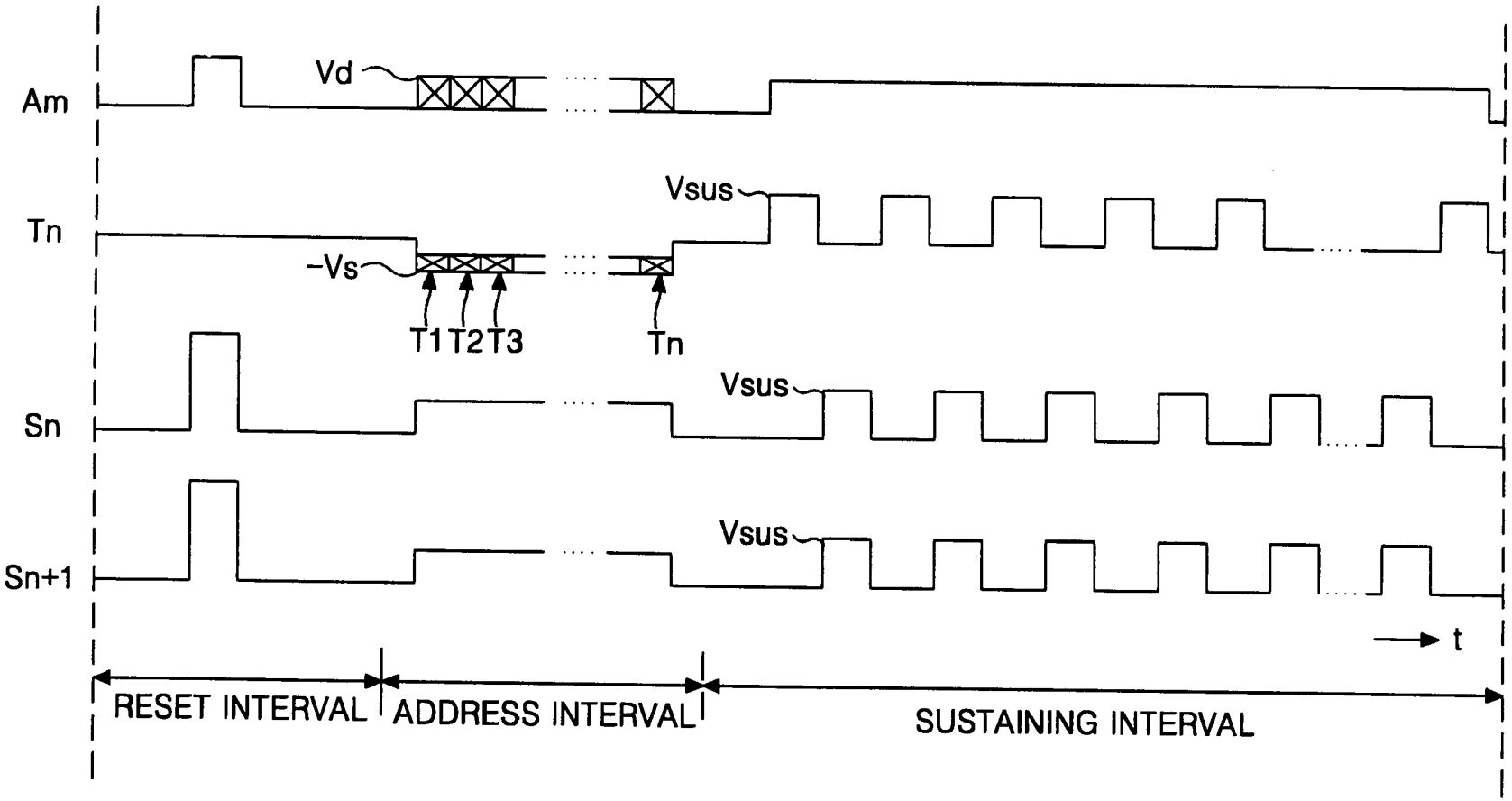
FIG. 7 is waveform diagrams of driving signals applied to the AC-type plasma display panel shown in FIG. 5.

FIG. 7 shows a method of driving an AC surface-discharge PDP according to a first embodiment of the present invention.

Referring now to FIG. 7, one sub-field is divided into a reset interval RP for initializing all of the discharge cells, an address interval AP for selecting a discharge cell to be turned on and a sustaining interval SP for sustaining a discharge at the discharge cell selected in the address interval AP. First, in the reset interval RP, a reset pulse is applied to each sustaining electrode line Sn and SDn+1 to generate a reset discharge. In the address interval AP, a scanning voltage pulse −Vs is sequentially applied to the trigger electrode Tn for each sustaining electrode line Sn and Sn+1 and a data pulse Vd is applied to the address electrode An in synchronization with the scanning voltage pulse, thereby generating an address discharge at the discharge cells supplied with a data. The discharge cell selected by the address discharge sustains a discharge in the following sustaining interval SP to emit a light. In the sustaining interval SP, a sustaining pulse Vsus is alternately applied to the trigger electrode Tn and the sustaining electrodes Sn and Sn+1. At this time, a sustaining discharge is generated only at the discharge cells selected by a voltage difference Vsus between the trigger electrode Tn and the sustaining electrodes Sn and Sn+1. As shown in FIG. 7, the same sustaining waveform is applied to the nth sustaining electrode Sn and the (n+1)th sustaining electrode Sn+1 at the nth discharge cell Cn. During the sustaining interval SP, twice sustaining discharge is generated between three electrodes of the nth sustaining electrode Sn, the nth trigger electrode Tn and the (n+1)th sustaining electrode Sn+1. More specifically, a primary sustaining discharge is generated between the nth discharge-sustaining electrode Sn and the nth trigger electrode Tn having a narrow distance from each other by a voltage difference Vsus. This primary sustaining discharge forms wall charges and charged particles at the discharge space 88. Next, a voltage derived from the wall charges and the charged particles formed by the primary sustaining discharge is added to the sustaining voltage Vsus between the nth trigger electrode Tn and the (n+1)th sustaining electrode Sn+1 to form a higher discharge voltage within the discharge cell, thereby generating a secondary sustaining voltage between the nth trigger electrode Tn and the (n+1)th sustaining electrode Sn+1 having a relatively long distance from each other. In other words, a primary discharge between the nth sustaining electrode Sn and the nth trigger electrode Tn serves as a priming discharge of the secondary discharge generated between the nth trigger electrode Tn and the (n+1)th sustaining electrode Sn+1 having a long distance from each other.

In the present invention, twice discharge is generated for each sustaining pulse by such a driving method. This obtains an effect of increasing a discharge frequency in the sustaining interval into two times in comparison to the conventional three-electrode PDP in which once discharge is generated for each sustaining pulse. Accordingly, in the present PDP, a discharge efficiency can be not only largely increased, but also the brightness of the PDP caused by the sustaining discharge can be largely improved when compared with the conventional three-electrode structure. Furthermore, since a discharge is generated between the nth trigger electrode Tn and the (n+1)th sustaining electrode Sn+1 having a relatively long distance from each other, a discharge path is more lengthened than that in the prior art to increase a generated quantity of an ultraviolet ray and a real light-emission area is much more enlarged than that in the prior art to permit a realization of a high efficiency and a high brightness.

Figure 8:
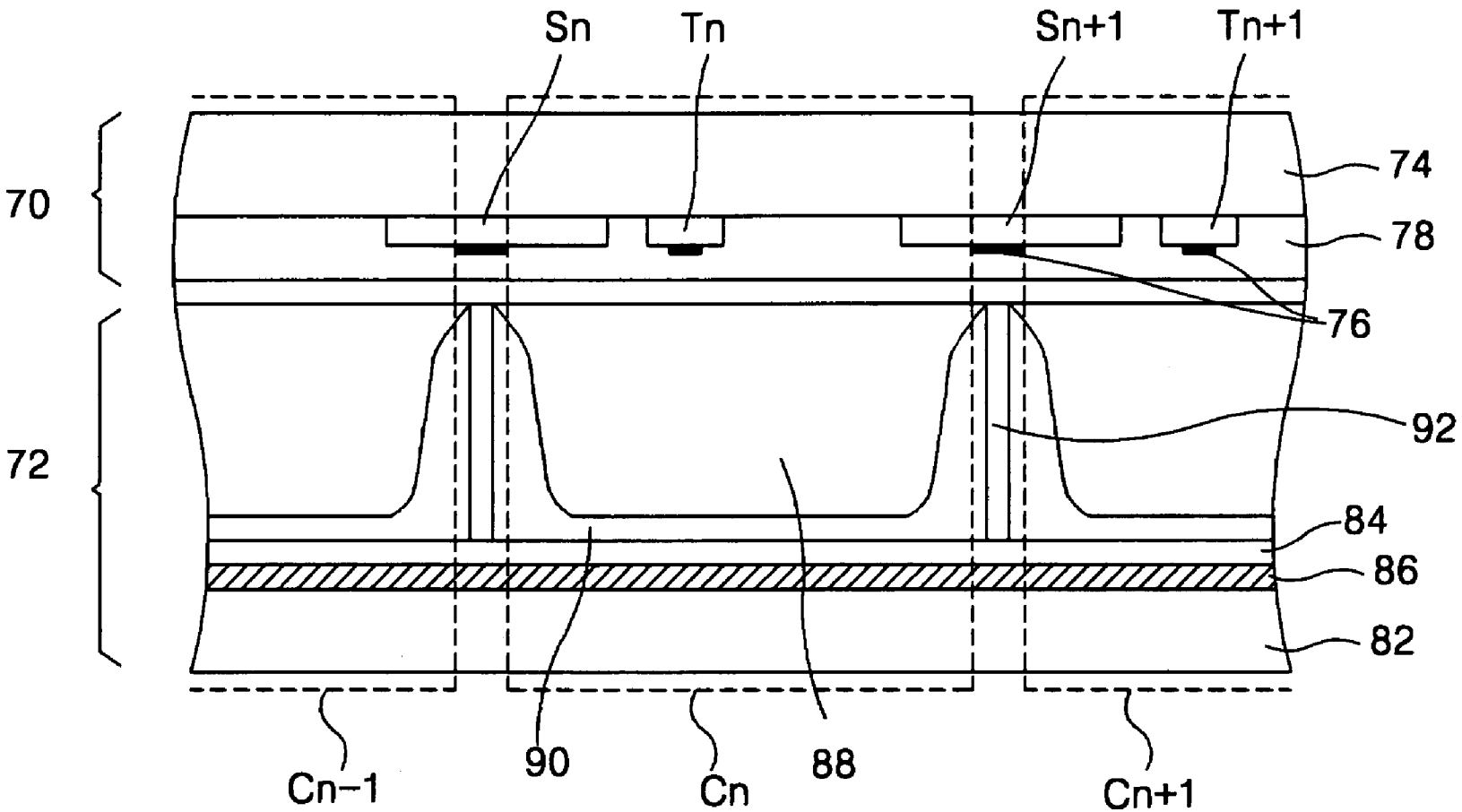
FIG. 8 is a section view showing a discharge cell structure of an AC surface-discharge plasma display panel according to a second embodiment of the present invention.

FIG. 8 shows a discharge cell structure of a AC surface-discharge PDP according to a second embodiment of the present invention.

The second embodiment has a difference from the first embodiment in that a metal bus electrode 76 having a light-shielding property is formed at each center of the rear sides of sustaining electrodes Sn and Sn+1 and trigger electrodes Tn and Tn+1. Other elements and features in the second embodiment are identical to those in the first embodiment.

Figure 1:
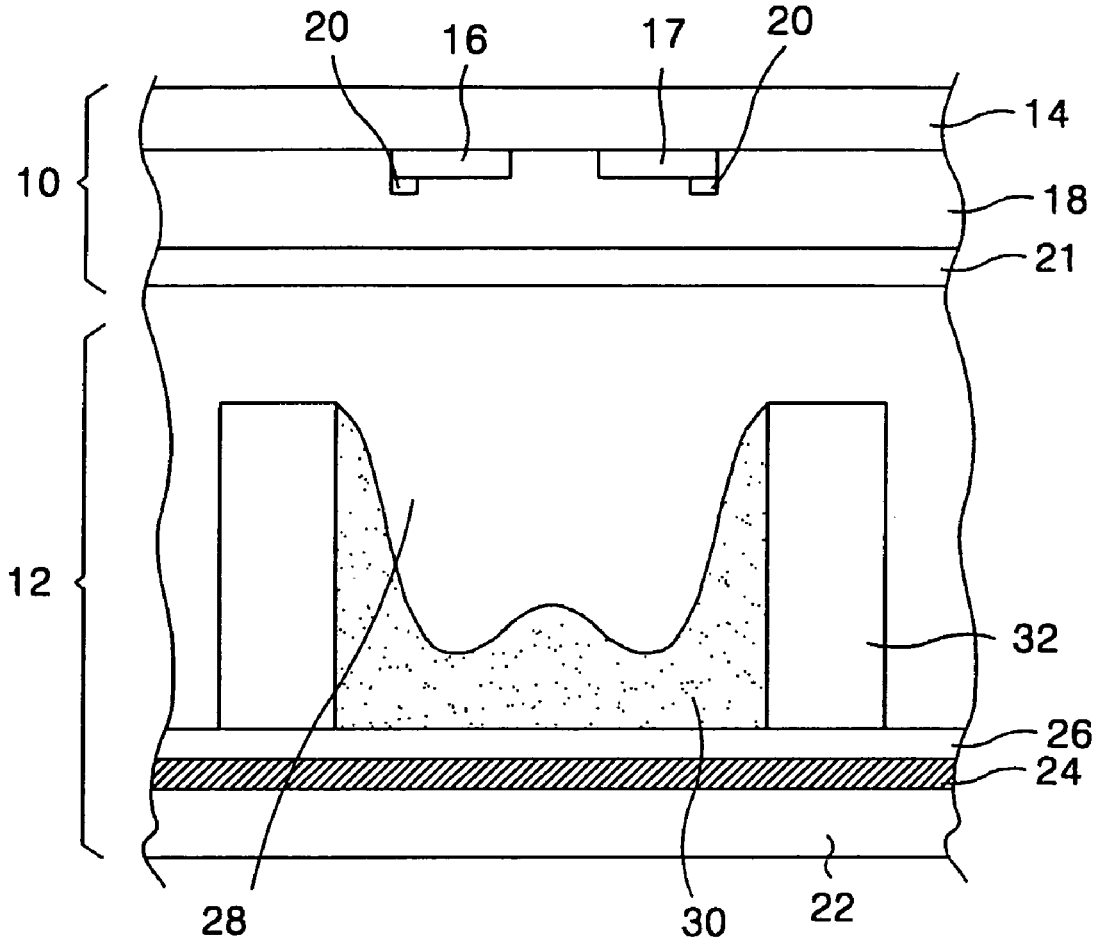
FIG. 1 CONVENTIONAL ART
FIG. 1 is a vertical section view showing a structure of a discharge cell of a conventional AC surface-discharge plasma display panel.
Figure 2:
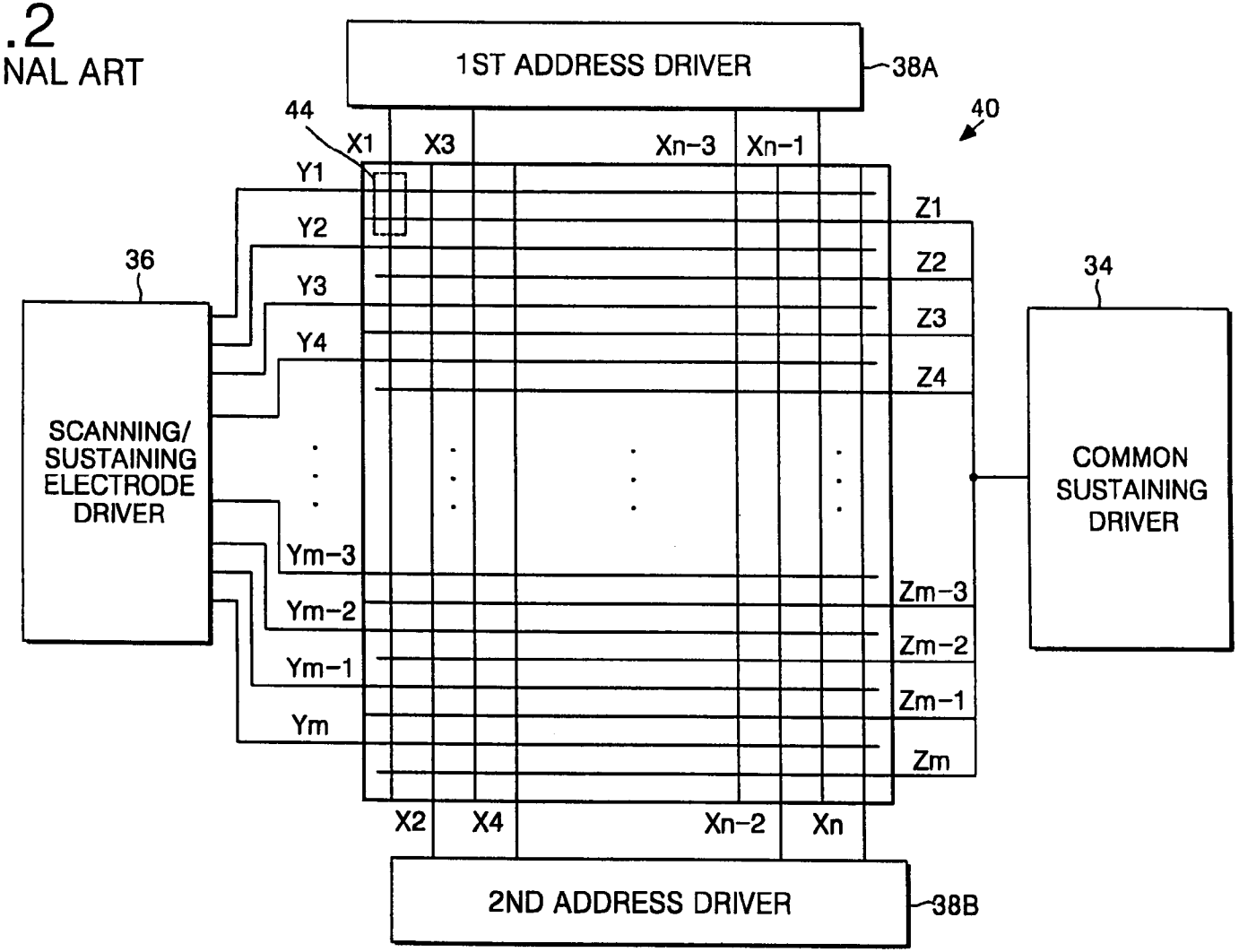
FIG.2 CONVENTIONAL ART
FIG. 2 is a plan view representing an arrangement of the pixel cells and the electrode lines of the AC-type plasma display panel shown in FIG. 1.
Figure 3:
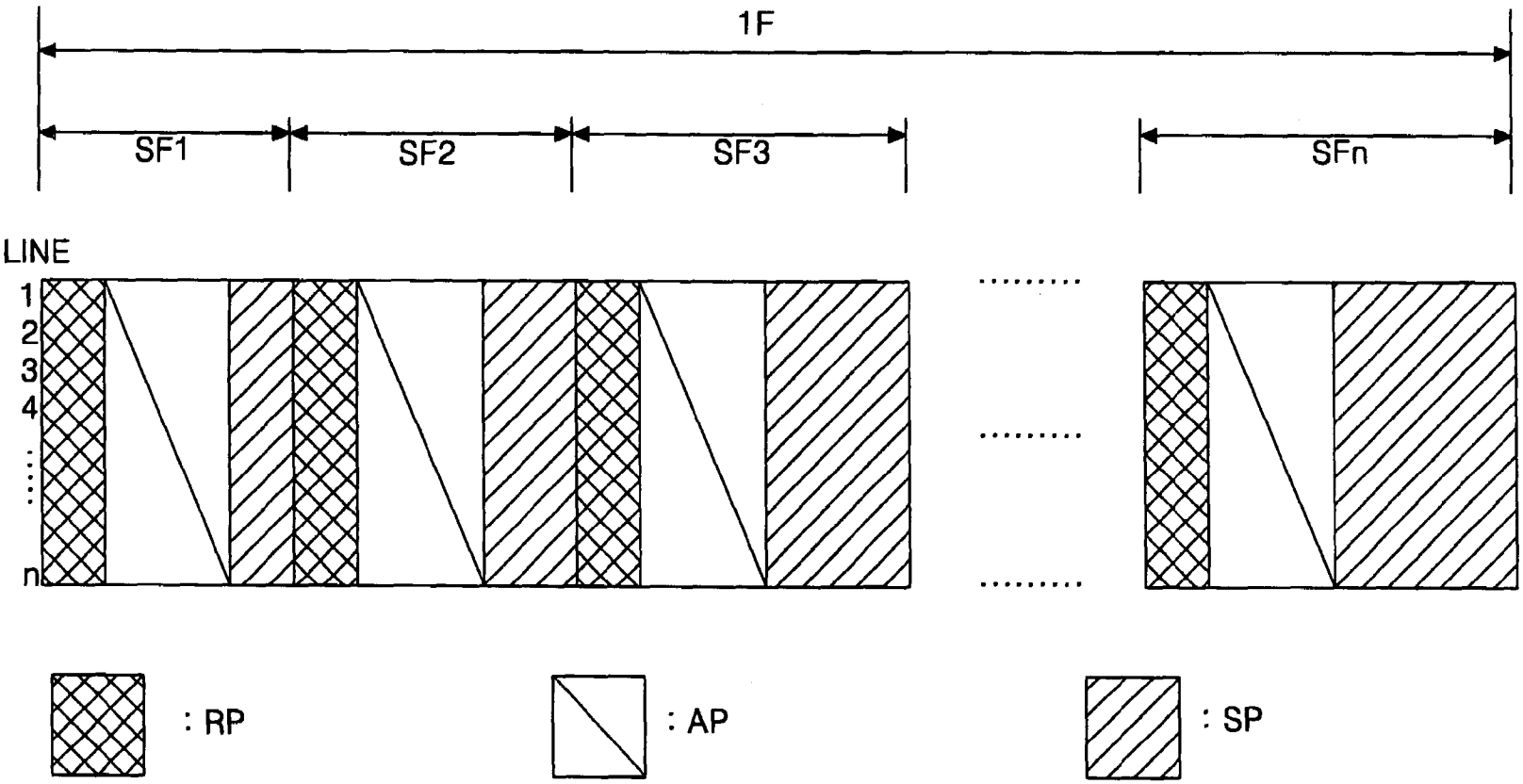
FIG.3 CONVENTIONAL ART
FIG. 3 illustrates a configuration of one frame for providing a gray level display of the plasma display panel shown in FIG. 1.
Figure 4:
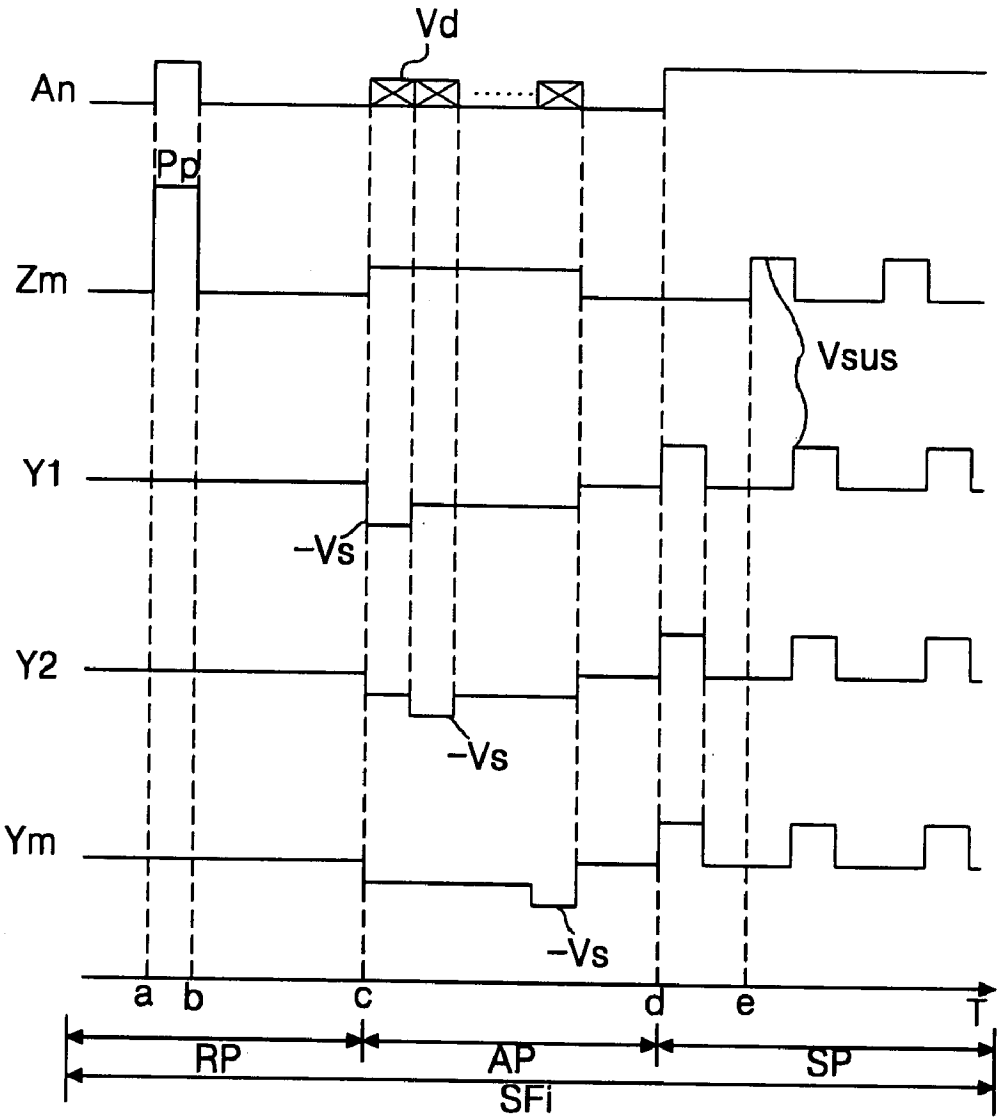
FIG. 4 CONVENTIONAL ART
FIG. 4 is waveform diagrams of driving signals applied to the plasma display panel during a certain sub-field interval shown in FIG. 3.

A driving method for the second embodiment of the present invention is identical to that for the first embodiment shown in FIG. 1. In the sustaining interval SP after an address discharge, a primary priming discharge is generated between the nth sustaining electrode Sn and the nth trigger electrode Tn having a narrow distance from each other at the nth discharge cell Cn. Subsequently, a secondary sustaining discharge having a long discharge path is generated between the (n+1)th sustaining electrode Sn+1 and the nth trigger electrode Tn. The second embodiment of the present invention also generates twice discharge every sustaining pulse to improve the brightness. Furthermore, the second embodiment has a long discharge path and an enlarged light-emission area so that it can realize a high efficiency and a high brightness. In addition, the second embodiment has the light-shielding bus electrode 76 formed at the center of each sustaining electrode Sn and Sn+1, so that it can prevent a resolution caused by an optical interference from being deteriorated at the boundary portion between the emitted cell and the non-emitted cell. Moreover, it can reduce a deterioration of a black color display quality.

Figure 9:
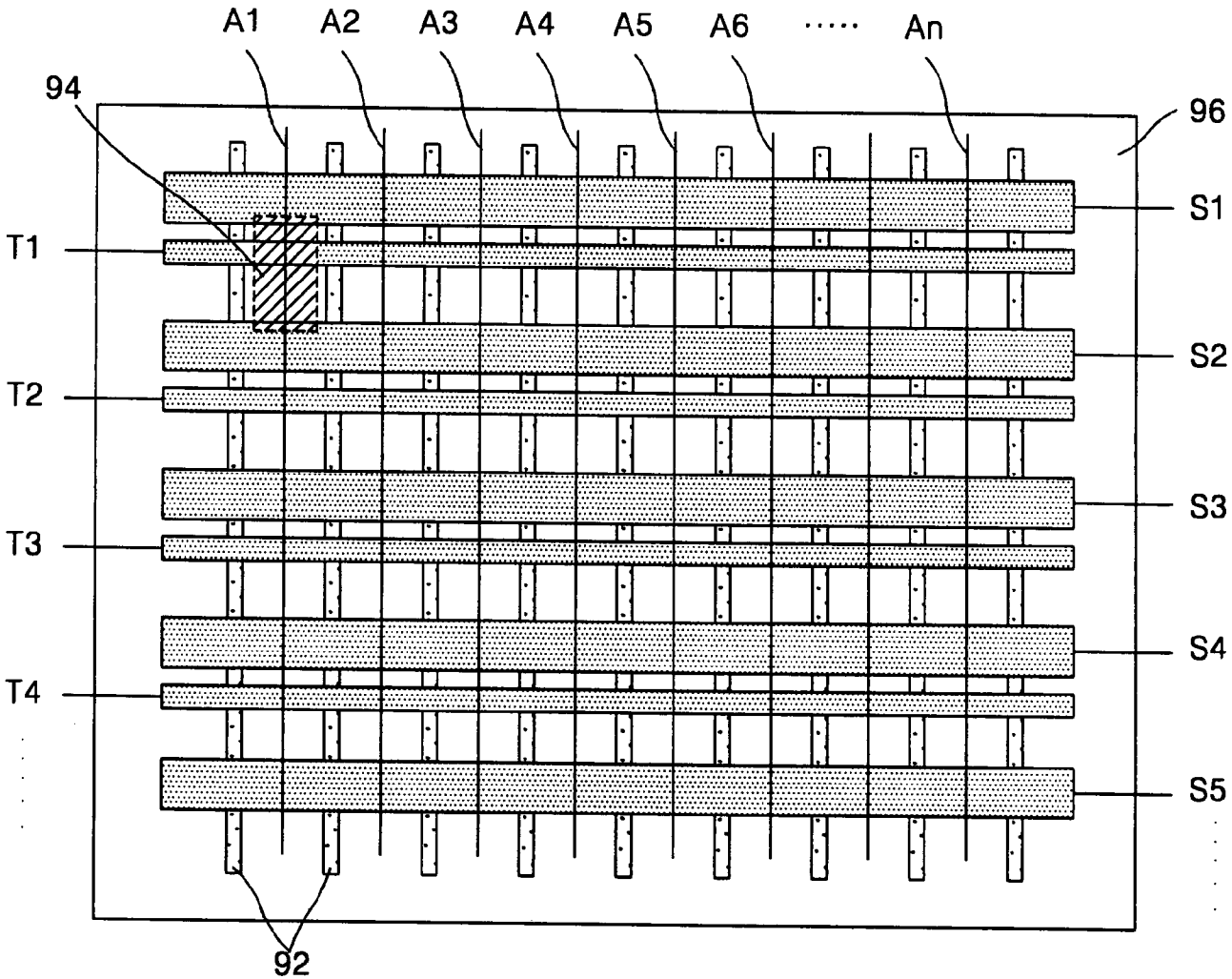
FIG. 9 is a plan view showing a structure of an AC surface-discharge plasma display panel according to a third embodiment of the present invention.

FIG. 9 shows a structure of an AC surface-discharge PDP according to a third embodiment of the present invention.

When the third embodiment shown in FIG. 9 is compared with the first embodiment shown in FIG. 6, it has a structure in which any horizontal barrier ribs does not exist between the scanning lines. As mentioned above, a sustaining discharge at the nth discharge cell Cn is caused by three electrodes of the nth sustaining electrode Sn, the nth trigger electrode Tn and the (n+1)th sustaining electrode Sn+1 to achieve a high efficiency and a high brightness. Since the third embodiment has barrier ribs taking a stripe shape rather than a lattice shape, it has an advantage in that a panel structure and a manufacturing process can be simplified. However, the PDP according to the third embodiment does not have any horizontal barrier ribs for dividing the sustaining electrode lines S1, S2, S3, S4, . . . , but has only vertical barrier ribs 92 formed in a direction parallel to the address electrodes A1 to An. Red (R), green (G) and blue (B) pixels arranged horizontally along the address electrode lines A1 to An at a single sustaining electrode line are divided by the vertical barrier ribs 92 to prevent an erroneous discharge between the pixels. But, an erroneous discharge may be generated between discharge cells positioned at the adjacent sustaining electrode lines. In order to prevent such an erroneous discharge, a driving method as shown in FIG. 10 to FIG. 13 is utilized.

Figure 10:
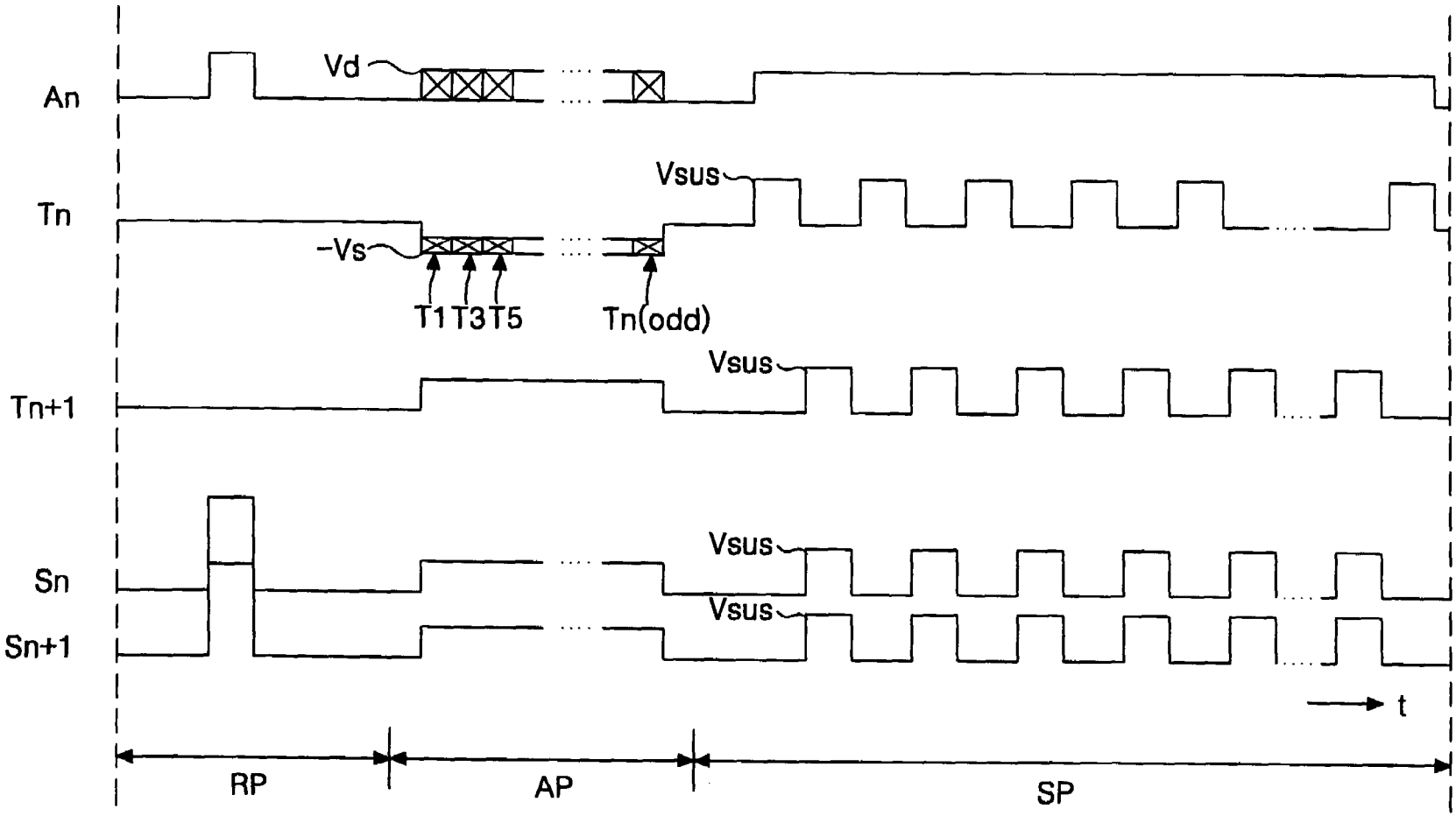
FIG. 10 and FIG. 11 are waveform diagrams of an example of driving signals applied to the AC surface-discharge plasma display panel shown in FIG. 9.
Figure 11:
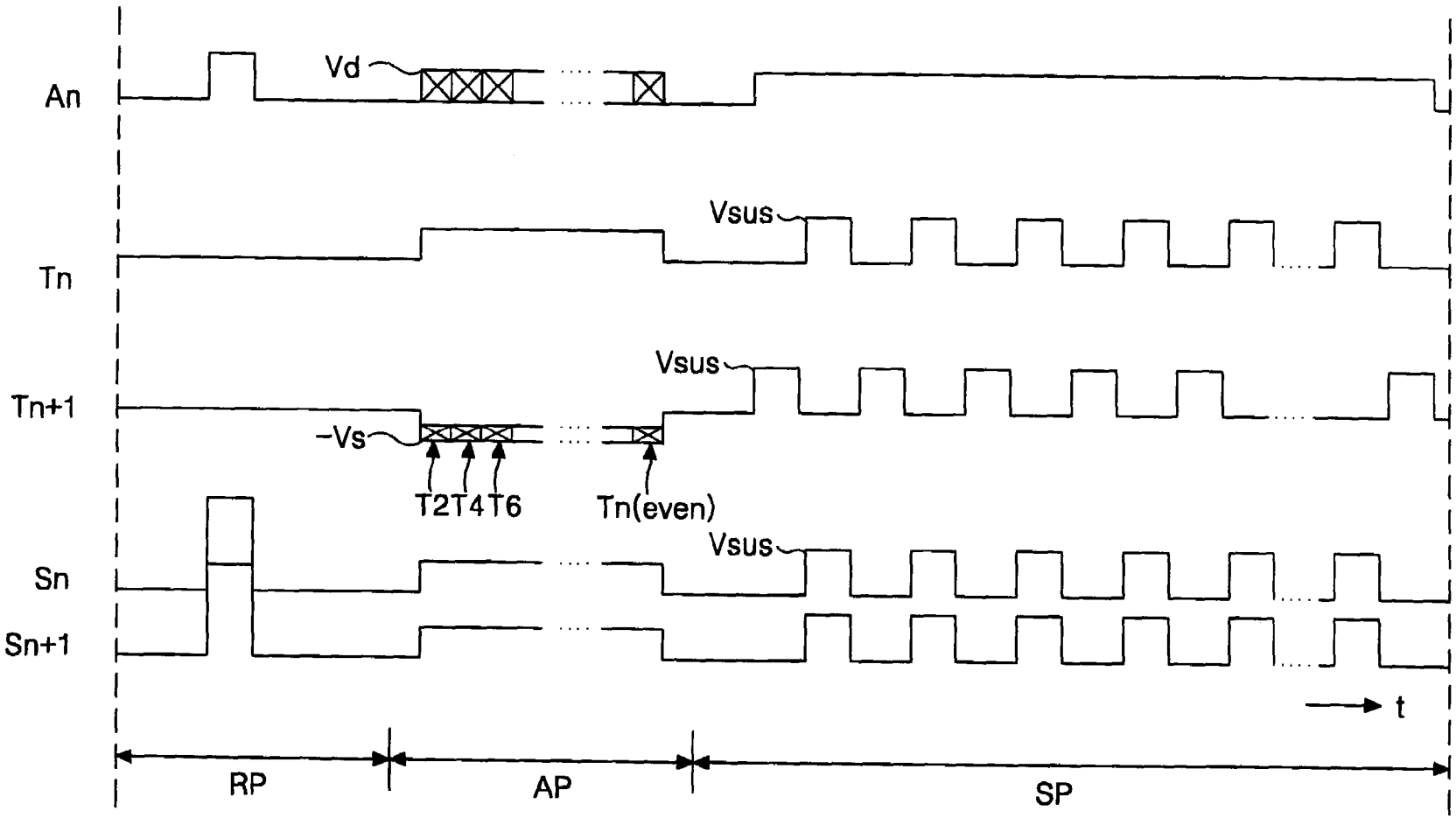

FIG. 10 and FIG. 11 are waveform diagrams for explaining an example of driving methods applied to the AC surface-discharge PDP according to the third embodiment of the present invention.

Referring to FIGS. 10 and 11, the trigger electrode lines are divided into odd-numbered trigger electrode lines Tn and even-numbered trigger electrode lines Tn+1 for a driving. In FIG. 10, a reset pulse Rp is first applied to each sustaining electrode Sn and Sn+1 upon driving of the odd-numbered trigger electrode lines Tn to entirely cause a reset discharge. Next, a sustaining pulse −Vs is applied to the odd-numbered trigger electrode line Tn and, at the same time, a data pulse is applied to each address electrode An, thereby generating an address discharge at the discharge cell Cn provided with the Odd-numbered trigger electrode line Tn. A discharge is sustained in the following sustaining interval SP at the discharge cells Cn of the odd-numbered trigger electrode lines Tn selected by the address discharge. During the sustaining interval SP, a sustaining discharge is generated only at the discharge cells Cn of the odd-numbered trigger electrode lines Tn. To this end, a sustaining pulse Vsus is alternately applied to the odd-numbered electrode line Tn and the sustaining electrode lines Sn and Sn+1, and a voltage waveform identical to a waveform applied to the sustaining electrodes Sn and Sn+1 is applied to the even-numbered trigger electrode line Tn+1. Accordingly, a primary sustaining discharge is generated at the discharge cells provided with the odd-numbered trigger electrode line Tn due to voltage differences Vsus between the odd-numbered trigger electrodes T1, T3, T5, . . . and the first sustaining electrodes S1, S3, S5, . . . . Then, a voltage caused by charged particles produced at this time is added to a voltage difference between the trigger electrodes T1, T3, T5, . . . and the second sustaining electrodes S2, S4, S6, . . . to cause a secondary long-distance sustaining discharge. However, since a voltage difference between the even-numbered trigger electrodes T2, T4, T6, . . . and the sustaining electrodes S1 to Sn+1 is not generated at the discharge cells of the even-numbered trigger electrode Tn+1, a sustaining discharge is not generated.

Similarly, a driving waveform as shown in FIG. 11 is applied to each electrode upon driving of the even-numbered trigger electrode line Tn+1. First, a reset pulse Rp is applied to each sustaining electrode Sn and Sn+1 to entirely cause a reset discharge. Next, a scanning voltage pulse −Vs is applied to the even-numbered trigger electrode line Tn+1 and, at the same time, a data pulse Vd is applied to each address electrode An, thereby generating an address discharge at the discharge cells Cn+1 provided with the even-numbered trigger electrode line Tn+1. A discharge is sustained in the following sustaining interval SP at the discharge cells Cn+1 provided with the even-numbered trigger electrode lines Tn+1 selected by the address discharge. During the sustaining interval SP, a sustaining discharge is generated only at the discharge cells Cn+1 provided with the even-numbered trigger electrode lines Tn+1. To this end, a sustaining pulse Vsus is alternately applied to the even-numbered electrode line Tn+1 and the sustaining electrode lines Sn and Sn+1, and a voltage waveform identical to a waveform applied to the sustaining electrodes Sn and Sn+1 is applied to the odd-numbered trigger electrode line Tn. Accordingly, a primary sustaining discharge is generated at the discharge cells Cn+1 provided with the even-numbered trigger electrode line Tn+1 due to voltage differences Vsus between the even-numbered trigger electrodes T2, T4, T6, . . . and the first sustaining electrodes S2, S4, S6, . . . . Then, a voltage caused by charged particles produced at this time is added to a voltage difference between the trigger electrodes T2, T4, T6, . . . and the second sustaining electrodes S1, S3, S5, . . . to cause a secondary long-distance sustaining discharge. However, since a voltage difference between the odd-numbered trigger electrodes T1, T3, T5, . . . and the sustaining electrodes S1 to Sn+1 is not generated at the discharge cells of the odd-numbered trigger electrode Tn, a sustaining discharge is not generated.

Such a driving method is capable of preventing an erroneous discharge between the discharge cells provided with the adjacent sustaining electrode lines as well as obtaining an effect of high efficiency and high brightness according to a long-distance discharge, an increase of light-emission area and an increase of discharge frequency even though the barrier ribs are provided at the boundary portion between the discharge cells.

Figure 12:
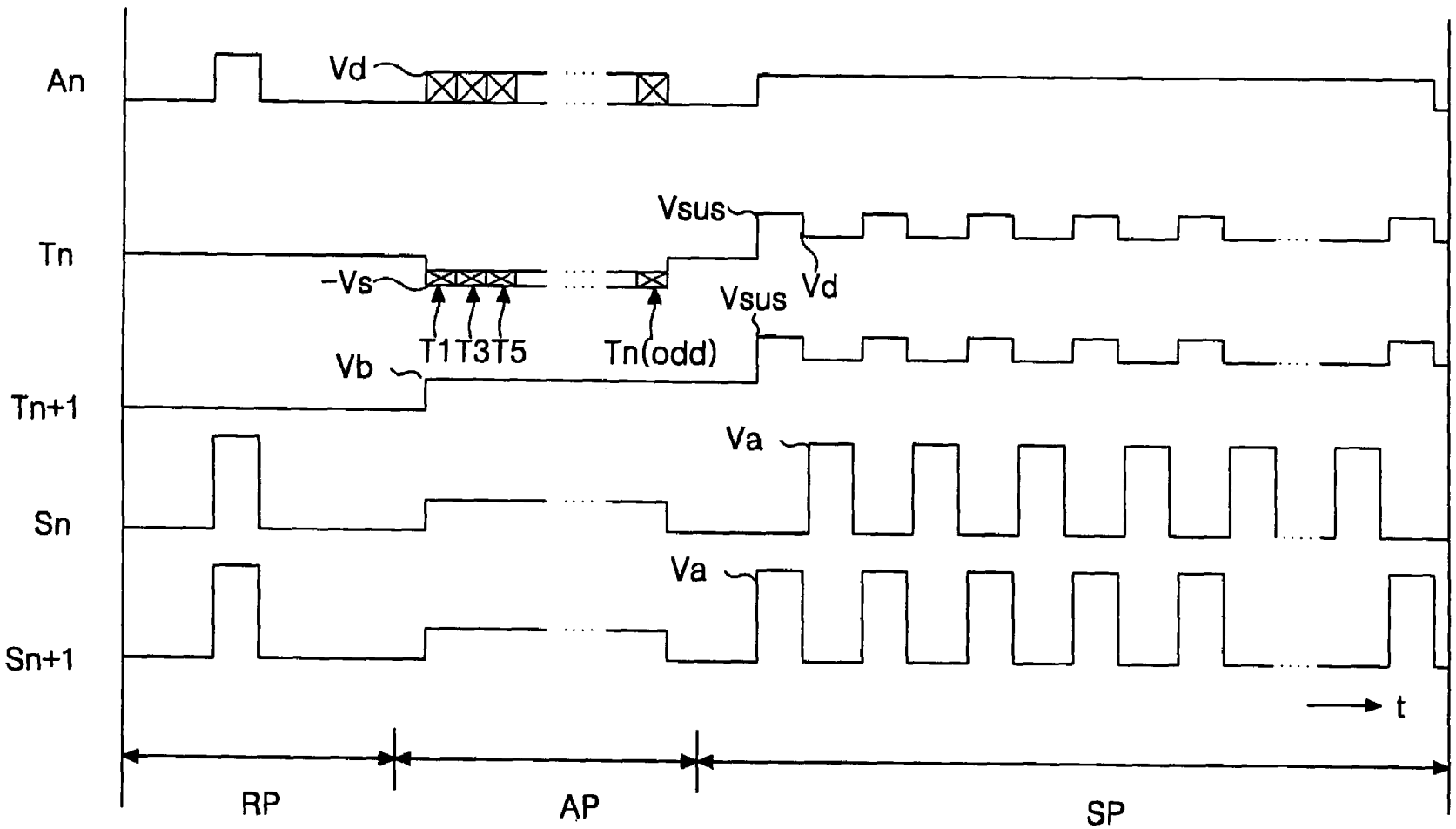
FIG. 12 and FIG. 13 are waveform diagrams of another example of driving signals applied to the AC surface-discharge plasma display panel shown in FIG. 9.
Figure 13:
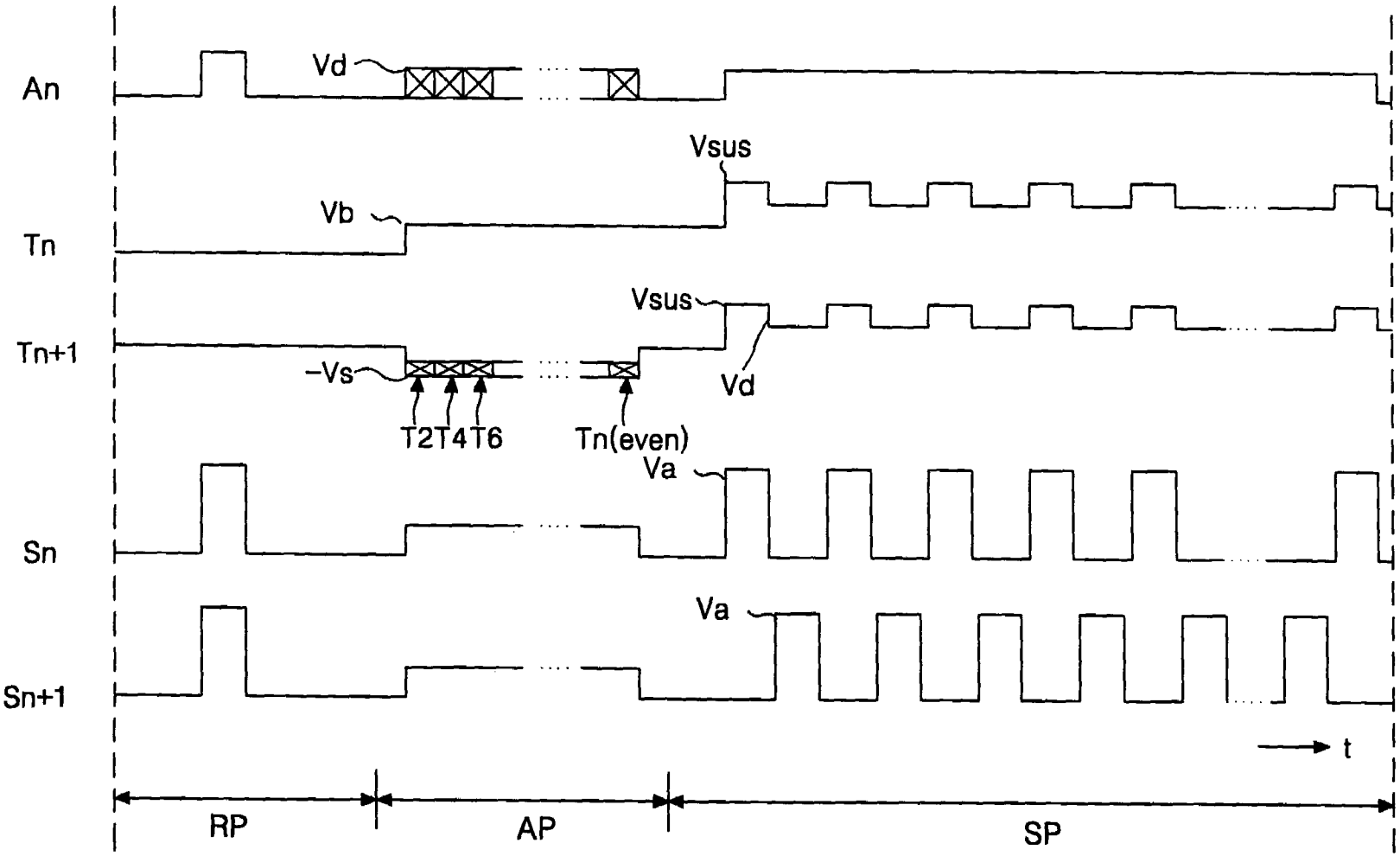

FIG. 12 and FIG. 13 are waveform diagrams for explaining another example of driving methods applied to the AC surface-discharge PDP according to the third embodiment of the present invention.

In the PDP according to the third embodiment, when a pulse voltage applied to the sustaining electrodes Sn and Sn+1 has a voltage level higher than a discharge initiating voltage Vsus required for the sustaining discharge, a selective sustaining operation may not be conducted normally. Driving waveforms for prevent this abnormal operation are shown in FIG. 12 and FIG. 13. In similarity to the driving method shown in FIG. 10 and FIG. 11, when the horizontal barrier ribs are provided between the sustaining electrode lines Sn and Sn+1 of the PDP, the trigger electrode lines are divided into odd-numbered trigger electrode lines Tn and the even-numbered trigger electrode lines Tn+1 for a driving.

FIG. 12 is waveform diagrams applied upon driving of the odd-numbered trigger electrode line Tn while FIG. 13 is waveform diagrams applied upon driving of the even-numbered trigger electrode line Tn+1.

As shown in FIG. 12 and FIG. 13, waveforms applied to the reset interval RP and the address interval AP are identical to those in FIG. 9 and FIG. 10. Upon driving of the odd-numbered trigger electrode line Tn, a scanning voltage pulse −Vs is applied to the even-numbered trigger electrode line Tn+1 and, at the same time, a data pulse Vd is applied to each address electrode An in synchronization with the scanning voltage pulse −Vs, thereby causing an address discharge at the discharge cells Cn formed at the odd-numbered trigger electrode line Tn to select the discharge cells to be turned on. Upon driving of the even-numbered trigger electrode line Tn+1, a scanning voltage pulse −Vs is applied to the even-numbered trigger electrode line Tn+1 and, at the same time, a data pulse Vd is applied to each address electrode An in synchronization with the scanning voltage pulse −Vs, thereby causing an address discharge at the discharge cells Cn+1 formed at the even-numbered trigger electrode line Tn+1. However, a waveform applied in the sustaining interval SP is different from that in FIG. 10 and FIG. 11.

First, with reference to the waveform diagrams of FIG. 12 applied to a driving of the odd-numbered discharge cell Cn, the same pulse waveform is applied to the odd-numbered trigger electrode line Tn and the even-numbered trigger electrode line Tn+1 in the sustaining interval SP. However, the pulse waveforms applied to the odd-numbered and even-numbered trigger electrode lines Tn and Tn+1 have a discharge initiating voltage Vsus having a high level. Herein, a low level is a desired voltage (Vb) level between 0V and Vsus rather than a ground voltage level 0V. Furthermore, a voltage pulse Va having a voltage level higher than the discharge initiating voltage Vsus is alternately applied to the odd-numbered sustaining electrode line Sn and the even-numbered sustaining electrode line Sn+1. When a high voltage level Vsus is applied to the trigger electrode lines Tn and Tn+1 as shown in FIG. 12, the voltage pulse Va is applied to the even-numbered sustaining electrode line Sn+1. On the other hand, when a low voltage level Vb is applied to the trigger electrode lines Tn and Tn+1, the voltage pulse Va is applied to the odd-numbered sustaining electrode line Sn. According to such a pulse application method, a primary priming sustaining discharge is generated at the odd-numbered discharge cell Cn due to a voltage difference Vsus or Va−Vb between the odd-numbered trigger electrodes T1, T3, T5, . . . and the odd-numbered sustaining electrodes S1, S3, S5, . . . . In this case, levels of Va and Vb should be appropriately selected such that a value of Va−Vb becomes more than the discharge initiating voltage. A priming effect of charged particles is added to a voltage difference (Va−Vsus or Vb) effect between the odd-numbered trigger electrode line Tn and the even-numbered sustaining electrode line Sn+1 after the primary priming discharge was generated at the odd-numbered discharge cell Cn, thereby causing a secondary long-distance sustaining discharge. However, since a voltage difference (Va−Vsus or Vb) between the even-numbered trigger electrode line Tn+1 and the even-numbered sustaining electrode line Sn+1 is lower than the discharge initiating voltage Vsus in a state in which charge particles are not produced, the first sustaining discharge is not generated at the even-numbered discharge cell Cn+1. As described above, the even-numbered discharge cell Cn+1 does not generate a discharge upon driving of the odd-numbered discharge cell Cn, so that an erroneous discharge can be prevented even though the barrier ribs is not provided between the discharge cells and a selective sustaining discharge can be smoothly performed without any erroneous operation even though an excessive high voltage is applied to the sustaining electrodes.

Similarly, with reference to the waveform diagrams of FIG. 13 applied to a driving of the even-numbered discharge Cell Cn+1, the same pulse waveform is applied to the odd-numbered trigger electrode line Tn and the even-numbered trigger electrode line Tn+1 in the sustaining interval SP.

Upon driving of the even-numbered discharge cell Cn+1, a high voltage level of the pulse waveforms applied to the odd-numbered and even-numbered trigger electrode lines Tn and Tn+1 is a discharge initiating voltage Vsus, and a low voltage level thereof is a desired voltage (Vb) level between 0V and Vsus rather than a ground voltage level 0V. When the high voltage level Vsus is applied to the trigger electrode lines Tn and Tn+1 as shown in FIG. 13, a voltage pulse Va is applied to the odd-numbered sustaining electrode line Sn. On the other hand, when a low voltage level Vb is applied to the trigger electrode lines Tn and Tn+1, the voltage pulse Va is applied to the even-numbered sustaining electrode line Sn+1. According to such a pulse application method, a primary priming sustaining discharge is generated at the even-numbered discharge cell Cn+1 due to a voltage difference Vsus or Va−Vb between the even-numbered trigger electrodes Tn+1 and the even-numbered sustaining electrodes Sn+1. A priming effect of charged particles is added to a voltage difference (Va−Vsus or Vb) effect between the even-numbered trigger electrode line Tn+1 and the odd-numbered sustaining electrodes Sn after the primary priming discharge was generated at the even-numbered discharge cell Cn+1, thereby causing a secondary long-distance sustaining discharge. However, since a voltage difference (Va−Vsus or Vb) between the odd-numbered trigger electrode line Tn and the odd-numbered sustaining electrode line Sn is lower than the discharge initiating voltage Vsus in a state in which charge particles have not been produced, the first sustaining discharge is not generated at the odd-numbered discharge cell Cn. As described above, the odd-numbered discharge cell Cn does not generate a discharge upon driving of the even-numbered discharge cell Cn+1, so that an erroneous discharge can be prevented even though the barrier ribs is not provided between the discharge cells and a selective sustaining discharge can be smoothly performed without any erroneous operation even though an excessive high voltage is applied to the sustaining electrodes.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A plasma display panel having discharge cells arranged in a matrix, comprising:

sustaining electrodes formed at and traversing the boundary portions between the discharge cells; and trigger electrodes formed at the inner sides of the discharge cells; wherein a scanning pulse is applied to the trigger electrodes during the address period; a first sustaining pulse is applied to the trigger electrodes during the sustaining period; and a second sustaining pulse is applied to the sustaining electrodes in such a manner to be alternate with the first sustaining pulse applied to the trigger electrodes.

2. The plasma display panel as claimed in claim 1, wherein the trigger electrodes are adjacent to any one of the sustaining electrodes formed at the boundary portions where they are formed.

3. The plasma display panel as claimed in claim 1, wherein the sustaining electrodes and the trigger electrodes are transparent electrodes.

4. The plasma display panel as claimed in claim 1, further comprising:

bus electrodes formed from a conductive material having a light-shielding property at the centers of the sustaining electrodes and the trigger electrodes.

5. The plasma display panel as claimed in claim 1, further comprising: first barrier ribs arranged in parallel to the sustaining electrodes.

6. The plasma display panel as claimed in claim 1, further comprising: first barrier ribs arranged in a direction crossing the sustaining electrodes.

7. The plasma display panel as claimed in claim 4, wherein barrier ribs overlap with the bus electrodes provided at the sustaining electrodes.

8. A method of driving a plasma display panel having sustaining electrodes formed at the boundary portions between the discharge cells, trigger electrodes formed at the inner sides of the discharge cells and lattice-shaped barrier ribs for surrounding the discharge cells, including a reset period, an address period and a sustaining period, wherein said sustaining electrodes are substantially overlapping and parallel to the boundary portions between the discharge cells, said method comprising the steps of:

applying a reset pulse to the sustaining electrodes during the reset period;

applying a scanning pulse to the trigger electrodes during the address period;

applying a first sustaining pulse to the trigger electrodes during the sustaining period; and applying a second sustaining pulse to the sustaining electrodes in such a manner to be alternate with the first sustaining pulse applied to the trigger electrodes.

9. The method as claimed in claim 8, wherein the first sustaining pulse and the second sustaining pulse are set to have the same voltage.

10. A method of driving a plasma display panel having sustaining electrodes formed at the boundary portions between the discharge cells, trigger electrodes formed at the inner sides of the discharge cells and barrier ribs formed in a direction crossing the sustaining electrodes, including a reset period, an address period and a sustaining period, wherein said sustaining electrodes are substantially overlapping and parallel to the boundary portions between the discharge cells, said method comprising:

a first sub-field for applying a scanning voltage pulse to odd-numbered trigger electrodes during the address period; and a second sub-field for applying a scanning voltage pulse to even-numbered trigger electrodes during the address period.

11. The method as claimed in claim 10, further comprising the steps of:

applying a first sustaining pulse to the odd-numbered trigger electrodes in the sustaining period of the first sub-field;

applying a second sustaining pulse alternating with the first sustaining pulse to the even-numbered trigger electrodes; and applying a third sustaining pulse synchronized with the second sustaining pulse to the sustaining electrodes.

12. The method as claimed in claim 11, wherein the first sustaining pulse, the second sustaining pulse and the third sustaining pulse are set to have the same voltage.

13. The method as claimed in claim 10, further comprising the steps of:

applying a first sustaining pulse to the trigger electrodes in the sustaining period of the first sub-field;

applying a second sustaining pulse to the even-numbered sustaining electrodes in synchronization with the first sustaining pulse; and applying a third sustaining pulse to the odd-numbered sustaining electrodes in such a manner to be alternate with the second sustaining pulse.

14. The method as claimed in claim 13, wherein the second sustaining pulse and the third sustaining pulse are set to have the same voltage level, and the first sustaining pulse is set to have a voltage level lower than the second and third sustaining pulse.

15. The method as claimed in claim 13, wherein the first sustaining pulse maintains a first voltage level when the second sustaining pulse is applied while having a second voltage level lower than the first voltage level when the third sustaining pulse is applied.

16. A method of driving a plasma display panel having sustaining electrodes formed at the boundary portions between the discharge cells, trigger electrodes formed at the inner sides of the discharge cells and barrier ribs formed in a direction crossing the sustaining electrodes, including a reset period, an address period and a sustaining period, wherein said sustaining electrodes are substantially overlapping and parallel to the boundary portions between the discharge cells, said method comprising:

a first sub-field for applying a scanning voltage pulse to even-numbered trigger electrodes during the address period; and a second sub-field for applying a scanning voltage pulse to odd-numbered trigger electrodes during the address period.

17. The method as claimed in claim 16, further comprising the steps of:

applying a first sustaining pulse to the even-numbered trigger electrodes in the sustaining period of the first sub-field;

applying a second sustaining pulse alternating with the first sustaining pulse to the odd-numbered trigger electrodes; and applying a third sustaining pulse synchronized with the second sustaining pulse to the sustaining electrodes.

18. The method as claimed in claim 17, wherein the first sustaining pulse, the second sustaining pulse and the third sustaining pulse are set to have the same voltage.

19. The method as claimed in claim 16, further comprising the steps of:

applying a first sustaining pulse to the trigger electrodes in the sustaining period of the first sub-field;

applying a second sustaining pulse to the odd-numbered sustaining electrodes in synchronization with the first sustaining pulse; and applying a third sustaining pulse to the even-numbered sustaining electrodes in such a manner to be alternate with the second sustaining pulse.

20. The method as claimed in claim 19, wherein the second sustaining pulse and the third sustaining pulse are set to have the same voltage level, and the first sustaining pulse is set to have a voltage level lower than the second and third sustaining pulse.

21. The method as claimed in claim 19, wherein the first sustaining pulse maintains a first voltage level when the second sustaining pulse is applied while having a second voltage level lower than the first voltage level when the third sustaining pulse is applied.

22. A plasma display panel, comprising:

first and second sustaining electrodes at opposing boundaries of a discharge cell, said first and second sustaining electrode extending across the opposing boundaries between adjacent discharge cells; and a trigger electrode formed in the discharge cells; wherein a scanning pulse is applied to the trigger electrodes during the address period; a first sustaining pulse is applied to the trigger electrodes during the sustaining period; and a second sustaining pulse is applied to the sustaining electrodes in such a manner to be alternate with the first sustaining pulse applied to the trigger electrodes.

23. The plasma display panel according to claim 22, wherein the trigger electrode is spaced nearer to the first sustaining electrode than the second sustaining electrode positioned in each discharge cell.

* * * * *

UNITED STATES PATENT AND TRADEMARK OFFICE

CERTIFICATE OF CORRECTION

PATENT NO. : 7,106,278 B2
APPLICATION NO. : 09/773935
DATED : September 12, 2006
INVENTOR(S) : Jae Sung Kim, Eun Cheol Lee and Seok Dong Kang It is certified that error appears in the above-identified patent and that said Letters Patent is hereby corrected as shown below:

On the Title Page Item (30) Foreign Application Priority Data should read

-- Feb. 3, 2000 (KR)……... 00-5457 --.

Signed and Sealed this

Twenty-sixth Day of December, 2006

JON W. DUDAS
*Director of the United States Patent and Trademark Office*